US007114191B1

(12) United States Patent
Butler-Penenberg

(10) Patent No.: US 7,114,191 B1
(45) Date of Patent: Oct. 3, 2006

(54) NURSING ENCLOSURE

(76) Inventor: Charlotte Butler-Penenberg, 9 Monroe Pl. #2, Brooklyn, NY (US) 11201

( * ) Notice: Subject to any disclaimer, the term of this patent is extended or adjusted under 35 U.S.C. 154(b) by 0 days.

(21) Appl. No.: 11/216,334

(22) Filed: Aug. 30, 2005

(51) Int. Cl.
*A41D 1/20* (2006.01)

(52) U.S. Cl. ..... 2/104; 2/46

(58) Field of Classification Search ..... 2/104, 2/48, 49.1–49.5, 50, 51, 52, 91, 94, 106, 2/46, 88, 69.5, 114; 224/158, 159, 160, 161; D2/860, 861, 863, 864
See application file for complete search history.

(56) References Cited

U.S. PATENT DOCUMENTS 1,385,391 A * 7/1921 Pease ..... 2/50
2,457,725 A * 12/1948 Rhowmine ..... 2/49.5
2,629,870 A * 2/1953 Hudson ..... 2/49.1
2,697,222 A * 12/1954 Reid ..... 2/49.2
2,762,053 A * 9/1956 Lipscomb ..... 2/49.5
2,822,548 A * 2/1958 Rhowmine ..... 2/49.5
2,897,505 A * 8/1959 Lipscomb ..... 2/48
4,579,264 A * 4/1986 Napolitano ..... 224/160
4,631,754 A * 12/1986 Ryan ..... 2/104
5,259,068 A 11/1993 Carroll
5,544,364 A 8/1996 Weber
5,592,692 A 1/1997 Larson
5,652,958 A 8/1997 Farrell-Mestas
6,216,273 B1 4/2001 Williams
6,536,047 B1 * 3/2003 Mullaly ..... 2/48
6,789,265 B1 * 9/2004 Vonrinteln ..... 2/49.2

* cited by examiner

*Primary Examiner*—Amy B. Vanatta
(74) *Attorney, Agent, or Firm*—H. Michael Brucker

(57) ABSTRACT

A nursing enclosure which protects the modesty of a nursing mother and provides a nursing child with a defined enclosure separating it from the immediate environment.

2 Claims, 4 Drawing Sheets

NURSING ENCLOSURE

BACKGROUND OF THE INVENTION

The present invention relates generally to devices useful to protect the modesty of a nursing mother and to provide a nursing child with a defined enclosure separating it from the immediate environment.

Prior art devices for such use by nursing mothers are almost all of the bib type wherein a panel of material is secured around the mother's neck and draped over the nursing child. The present invention, which is secured around the neck of the nursing mother, not only drapes over the nursing child, but provides means for enclosing the mother's arms and, in so doing, more fully encapsulates the child, separating it from the immediate environment.

BRIEF DESCRIPTION OF THE INVENTION

In the present invention, an enclosure is formed by a fabric front panel having dimensions sufficient to extend from the area of the nursing mother's neck to the area of her waist, which is bordered by a neckline edge, a bottom edge and two spaced-apart side edges extending from the neck edge to the bottom edge. A fabric back panel extends from the side edges and the bottom edge and terminates in an elastic expandable, generally u-shaped back panel edge. A pair of straps extending from either end of the neckline edge provide a means for securing the enclosure of the invention around the mother's neck.

Once the enclosure of the invention is secured around the neck of the nursing mother and the nursing child is cradled in one of the mother's arms, the expandable edge of the back panel is drawn around the back of the mother's supporting arm and then around the other arm so that both arms and the nursing child are covered by the front panel, which is held in place by the elasticity of the back panel expandable edge.

By securing the neckline edge around the mother's neck loosely, the nursing child can be easily observed by the mother by using the free hand to gently push the neckline edge away from the mother's neck area.

Accordingly, it is an object of the present invention to provide a fabric enclosure for a nursing baby which protects the mother's modesty and provides the child with an enclosure that separates it from the immediate environment.

This and other objects and advantages of the present invention will become readily apparent upon further review of the following specification and drawings.

DETAILED DESCRIPTION OF THE PREFERRED EMBODIMENTS

Figure 1:
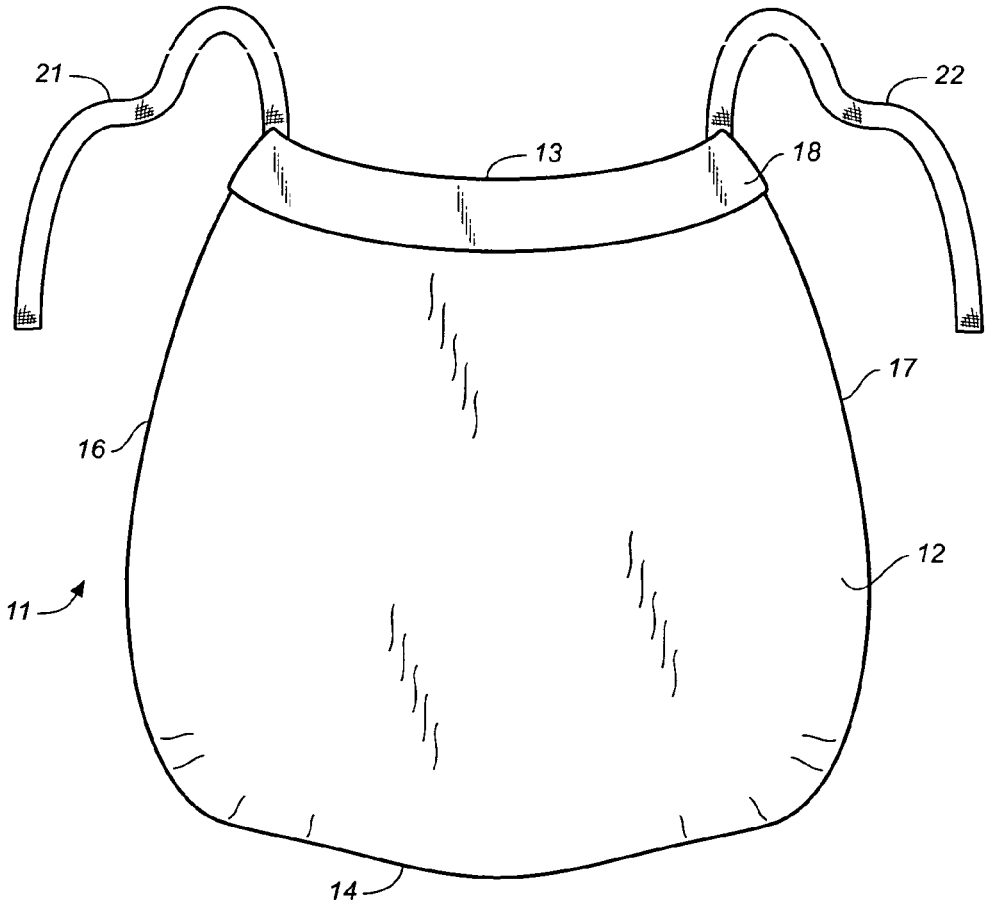
FIG. 1 is a front view of the enclosure of the present invention showing the front panel and the securing straps.

Referring to FIG. 1, the enclosure 11 has a fabric front panel 12 having dimensions sufficient to extend from the area of a woman's neck to the area of her waist and bordered by a neckline edge 13, a bottom edge 14 and spaced-apart side edges 16 and 17 which extend from neckline edge 13 to bottom edge 14. While the fabric front panel 12 is illustrated as having a generally rectangular shape, which is the preferred embodiment, variations of that shape, including round and oval, will not depart from the scope of the invention, as will be readily appreciated from what follows. A cuff 18 extending from the neckline edge 14 is a common way to finish the neckline, although it is not essential to the invention.

Figure 5:
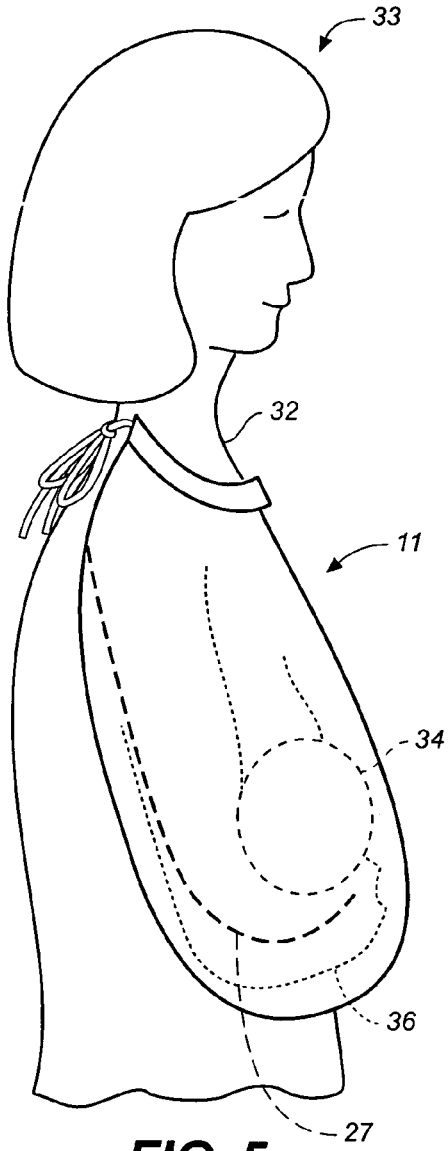
FIG. 5 is a side view showing the enclosure of the present invention deployed in connection with a nursing mother and a nursing child.
Figure 4:
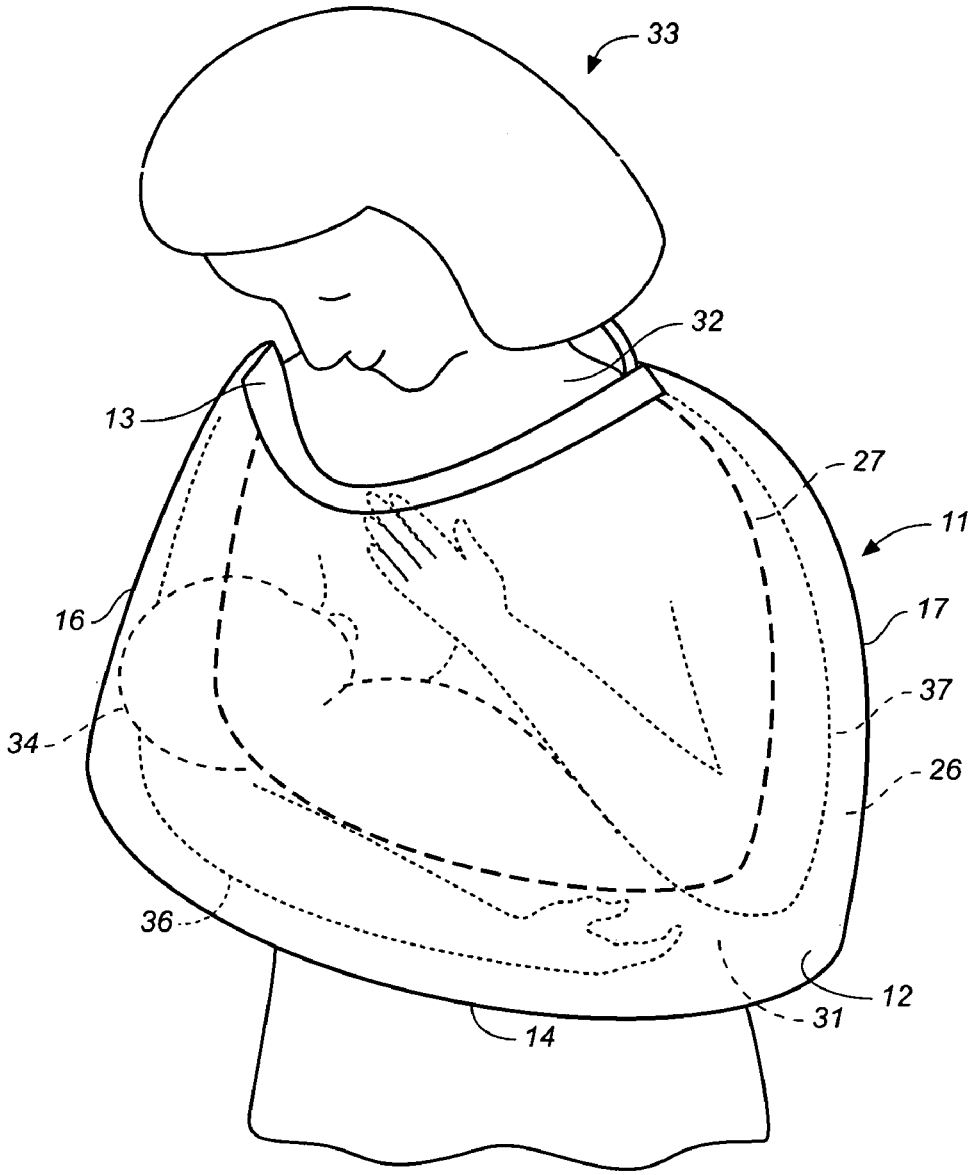
FIG. 4 is a front perspective drawing of a nursing mother and nursing child with the nursing enclosure of the present invention deployed.

Extending from either end of neckline 13 are securing straps 21 and 22 which provide a means for securing the enclosure 11 around the neck of a nursing mother, as illustrated in FIGS. 4 and 5.

The straps 21 and 22 can be secured by simply tying in a bow or the like, as shown in FIG. 5, or can include any other well known securing means, such as Velcro, snaps, loop and hook, buttons, etc. Whatever securing means are used in connection with straps 21 and 22, they should permit the neckline 13 to hang loosely about the neck of the nursing mother so that it can be pushed away from the mother's neck in order for the mother to observe the nursing child, as best illustrated in FIG. 4.

Figure 2:
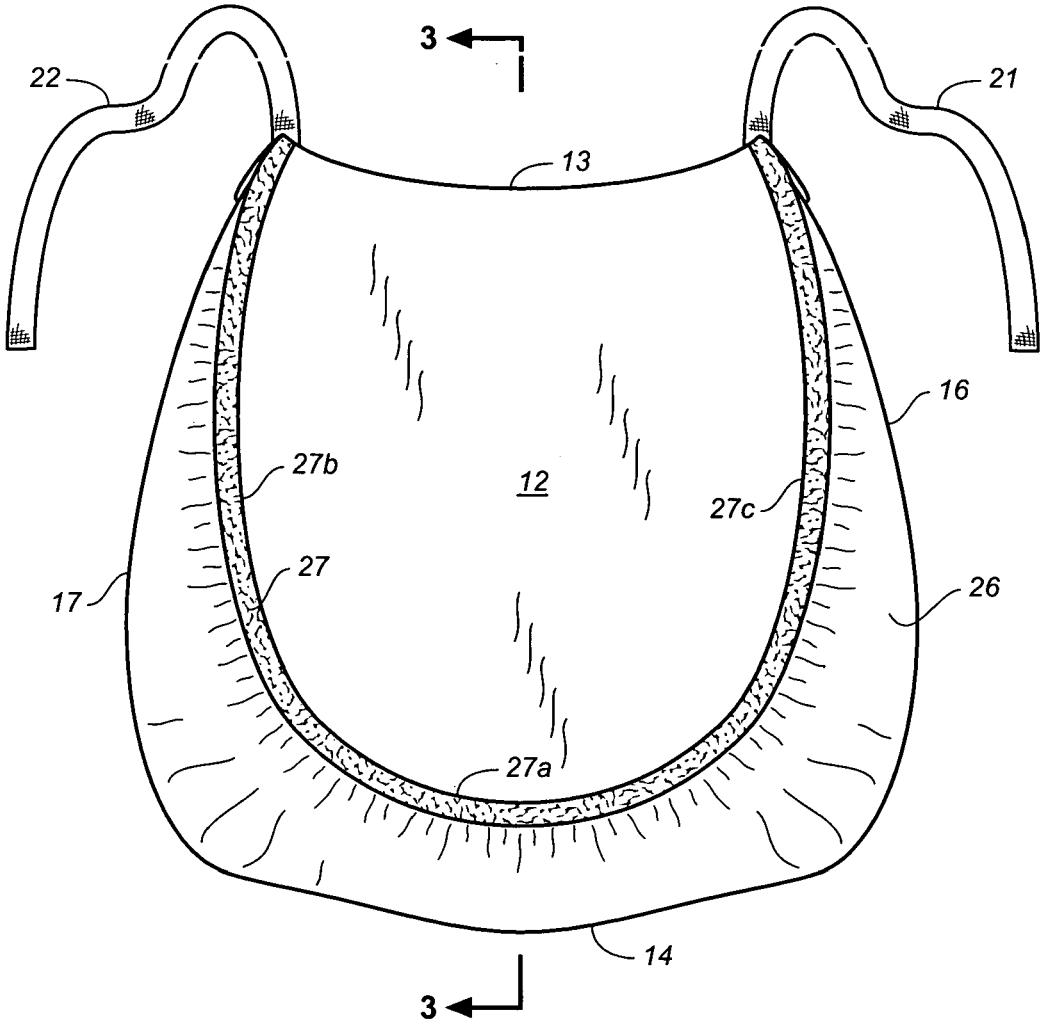
FIG. 2 is a back view of the enclosure of the present invention showing the back panel and its expandable, generally u-shaped edge.

Referring to FIG. 2, a fabric back panel 26 extends from the side edges 16 and 17 and bottom edge 14 of front panel 12. The back panel 26 terminates in a generally u-shaped edge 27 which is elastically expandable. The elastically expandable character of the back panel edge 27 is formed by any one of several known ways for making the edge of a fabric piece expandable, such as by sewing into the edge an elastic band while gathering the edge during the sewing. In this way, the edge 27 can expand when drawn over an object, such as the arms of a nursing mother, and then contract to hold the enclosure in place.

In the preferred embodiment, the front panel 12 and the back panel 26 are formed from the same piece of fabric and are therefore contiguous. Thus, while the invention has been described as having side edge 16 and 17 and bottom edge 14, in order to describe the front and back panels of the invention, it will be understood by those skilled in the art that no discernable edges 14, 16 or 17 may exist when the front and back panels are sewn from a single piece of fabric.

Figure 3:
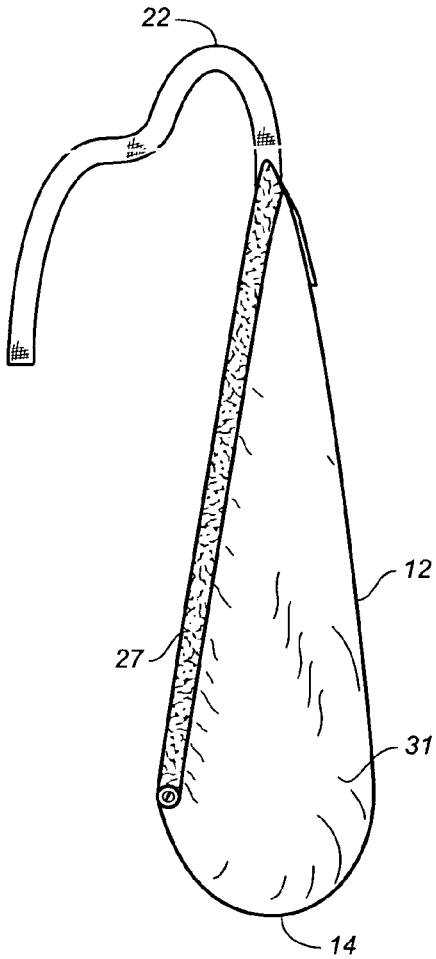
FIG. 3 is a sectional view of the invention taken along the lines 3—3 of FIG. 2.

As best seen in FIGS. 2 and 3, the elasticity of the back panel edge 27 causes its lower portion 27*a* to be drawn up above the bottom edge 14 and its side portions 27*b* and 27*c* to be drawn inward of side edges 17 and 16, respectively, to form a pouch 31.

As best seen in FIGS. 4 and 5, when the enclosure 11 is secured around the neck 32 of a nursing mother 33 cradling a nursing baby 34 in her right arm 36, and the back panel edge 27 is drawn around and secured behind arm 36 and the left arm 37, the child 34 is contained within the pouch area 31 and thereby more securely separated from the immediate environment than it would be if the enclosure 11 were of the drape type and terminated at the front panel edges 14, 16 and 17.

As shown in FIG. 4, by securing the enclosure 11 loosely around the neck 32 of the nursing mother 33, the neckline edge 13 can be pushed outwardly by the non-baby supporting arm 37 so that the nursing mother 33 can easily view the nursing child 34.

While numerous fabrics are suitable for making the invention, including cotton, wool, silk, linen, synthetics, blends and combinations thereof, in one preferred embodiment, the fabric is light weight cotton which is easily laundered and reducible to a small package which is convenient to carry.

Of course, various changes, modifications and alterations in the teachings of the present invention may be contemplated by those skilled in the art without departing from the intended spirit and scope thereof. As such, it is intended that the present invention only be limited by the terms of the appended claims.

What is claimed is:

1. A nursing enclosure for attachment to the neck of and for covering the upper front portion of a mother's body and enclosing a nursing infant, comprising:

a fabric front panel having a dimension sufficient to extend from the area of the mother's neck to the area of her waist and having a neckline edge terminating in opposing ends, a bottom edge and two spaced-apart side edges extending from the ends of said neckline edge to the bottom edge wherein said edges form a generally rectangular shape;

a fabric back panel extending from said side edges and said bottom edge and terminating in a gathered, generally u-shaped back panel edge wherein the ends of said u-shaped back panel edge are located in the general area where said neck edge intersects with each of said side edges;

elastic material sewn into the entire length of said gathered back panel edge whereby said generally u-shaped back panel edge is made expandable;

a pair of straps, each extending from the said neckline edge in the general area where it intersects with each of said side edges whereby when said straps are connected around the neck of a mother the neckline edge extends sufficiently below the neck that it can be positioned away from the mother's body a distance that allows the baby to be viewed by the mother.

2. The nursing enclosure of claim 1 wherein said front panel and said back panel are contiguous.

* * * * *